United States Patent [19]

Igel et al.

[11] Patent Number: 4,771,597

[45] Date of Patent: Sep. 20, 1988

[54] METHOD AND APPARATUS FOR AUTOMATICALLY EXCHANGING ROVING BOBBINS

[75] Inventors: Wolfgang Igel, Ebersbach; Werner Meissner, Hattenhofen; Herbert Koenig; Ulrich Hungerbuehler, both of Ebersbach, all of Fed. Rep. of Germany

[73] Assignee: Zinser Textilmaschinen GmbH, Fed. Rep. of Germany

[21] Appl. No.: 110,940

[22] Filed: Oct. 20, 1987

[30] Foreign Application Priority Data

Oct. 20, 1986 [DE] Fed. Rep. of Germany ..... 3635576

[51] Int. Cl.[4] ..... D01H 9/02; D01H 9/18; D01H 13/32; D01H 15/00

[52] U.S. Cl. ..... 57/264; 57/261; 57/268; 57/281

[58] Field of Search ..... 57/261–266, 57/268, 276–278, 281

[56] References Cited

U.S. PATENT DOCUMENTS

| | | | |
|---|---|---|---|
| 4,176,514 | 12/1979 | Stalder | 57/261 |
| 4,475,331 | 10/1984 | Promoli et al. | 57/263 |
| 4,665,686 | 5/1987 | Sumner et al. | 57/264 |

FOREIGN PATENT DOCUMENTS

| | | |
|---|---|---|
| 1785657 | 10/1977 | Fed. Rep. of Germany . |
| 2811128 | 12/1981 | Fed. Rep. of Germany . |
| 3216218 | 11/1983 | Fed. Rep. of Germany . |
| 3527473 | 2/1987 | Fed. Rep. of Germany . |

*Primary Examiner*—John Petrakes

*Attorney, Agent, or Firm*—Shefte, Pinckney & Sawyer

[57] ABSTRACT

A method and apparatus for automatically actuating roving bobbin exchange operations in a textile yarn spinning apparatus. The spinning stations are divided into equal groups and a roving bobbin exchange operation is actuated at each group by a suitable control system, e.g. a microprocessor, as a function of the number of spinning stations of the group identified as down with uncorrectable yarn breaks and as a further function of the total elapsed operating time of the group since the last bobbin exchange operation.

10 Claims, 2 Drawing Sheets

METHOD AND APPARATUS FOR AUTOMATICALLY EXCHANGING ROVING BOBBINS

BACKGROUND OF THE INVENTION

The present invention relates generally to textile yarn spinning methods and apparatus and, more particularly, to a method and apparatus for automatically exchanging roving bobbins in spinning apparatus of the type wherein yarn is spun from roving.

The textile yarn spinning apparatus to which the present invention relates may be ring spinning machines, spinning or twisting machines, cop spinning machines or can spinning machines in particular, although the present invention has applicability to other types of spinning machines as well. In such spinning machines, a plurality of yarn spinning stations are fed with roving supplied from a plurality of roving bobbins removably supported in a bobbin creel or the like. Conventionally, plate-like carriers, which are selectively mountable to and demountable from the bobbin creel, are utilized for pivotably suspending the roving bobbins in groups. In such creel arrangements, an automatic bobbin changing apparatus may be compatibly utilized for removing the bobbin carriers once the bobbins thereon are spent and exchanging a substitute carrier having a group of full bobbins. A representative example of such bobbin exchanging apparatus is disclosed in European Patent No. 62 063. A photoelectric scanner may be utilized to detect the exhaustion of the roving bobbins on each carrier and to actuate automatic operation of the bobbin exchanging apparatus to replace the carrier with a carrier containing full bobbins.

Ordinarily, the several roving bobbins grouped on a carrier will not exhaust their respective roving supplies simultaneously even though the unwinding of roving therefrom was begun simultaneously. Thus, a number of the spinning stations associated with each group of roving bobbins will typically be out of operation for varying periods of time after their associated roving bobbins empty while awaiting the next exchange of roving bobbins. As will be understood, this down time results in considerable losses in spinning production.

Another potential problem with the aforedescribed bobbin carriers is the risk that the carriers may sometimes be imprecisely or improperly positioned on the spinning machine which can result in breaks in the roving. Frequent roving breaks may also be caused by a poor quality of roving which, for example, may result from the intermittently faulty operation of the roving fly frame or other roving producing machine. As will be understood, breaks in the roving can cause extended down time and production losses at the respective spinning stations. Particularly, while it would be desirable to exchange roving bobbins in such situations in which frequent roving breaks occur, such roving breaks may remain unnoticed for extended times since the photoelectric sensors associated with an automatic bobbin exchanging apparatus will continue to detect the presence of roving and therefore will not actuate a roving bobbin exchange procedure.

Other potential problems in spinning apparatus may be associated with the yarn piecing devices which are commonly arranged as traveling carriages for movement along the plurality of spinning stations to automatically locate and correct yarn breakages occurring thereat. It is not unusual that such yarn piecing carriages may be unable to successfully correct a yarn break for various reasons. For example, a break in the roving feed to the spinning machine drafting system, the unintended wrapping of the roving around a drafting roller, the breakage of the spinning ring traveler, as well as many other occurrences, may prevent the yarn piecing carriage from performing its normal piecing operation. Accordingly, yarn piecing carriages are conventionally designed to make only a predetermined limited number of attempts, e.g. two or three attempts, to locate and piece a yarn break at any given spinning station. In the event the yarn break cannot be corrected by these attempts, the yarn piecing carriage is programmed to proceed to other spinning stations to eliminate yarn breaks thereat. Otherwise, as will be understood, the yarn piecing carriage would remain continuously at the spinning station having the uncorrectable yarn break. Such yarn piecing carriages are also programmed to record the identity of spinning stations having an uncorrectable yarn break (commonly referred to as "down" or "dead" spinning stations) so that the carriage does not again stop at such spinning station or stations as its traveling operational movement progresses. Such a yarn piecing system is disclosed in German Published Patent Application No. 24 54 721.

As will thus be understood, the occurrence of roving breaks such as described above will ultimately result in the detection of a yarn break at the associated spinning station with an attendant inability of an associated yarn piecing carriage to correct the detected yarn break. When a significant number of the roving bobbins in any given carrier group experience roving breaks, such as due to an improper positioning of the carrier or to defective roving, the corresponding spinning stations will each experience an uncorrectable yarn break while at the same time the bobbin exchanging apparatus will remain inactive since the roving bobbins will not have been spent. As a result, the spinning stations involved will remain down for an extended period of time with an attendant loss of production.

SUMMARY OF THE INVENTION

It is accordingly an object of the present invention to provide an improved method and apparatus for automatically exchanging roving bobbins in a textile yarn spinning apparatus using an automatic bobbin exchanging apparatus which will solve the foregoing problems and thereby will assist in reducing spinning production losses due to spinning stations which are down with uncorrectable yarn breaks.

Briefly summarized, the method and apparatus of the present invention basically involve the division of the plural spinning stations of a textile yarn spinning apparatus into groups each including a plurality of adjacent spinning stations. A suitable means is utilized for monitoring the spinning stations of each group to identify the number of stations of each group having a yarn break which an associated yarn piecing carriage cannot successfully correct, and an appropriate means is provided for actuating an associated automatic bobbin exchanging means to exchange the roving bobbins associated with a respective group of spinning stations in relation to the number thereof having uncorrectable yarn breaks.

According to the preferred embodiment of the present invention, the elapsed time following each bobbin exchange is also monitored by a suitable arrangement, with the automatic bobbin exchange means being actuated to exchange the roving bobbins associated with a respective group of spinning stations in relation to the elapsed operating time of the associated roving bobbins. Preferably, a program stores a theoretically calculated time period required for complete exhaustion of a full roving bobbin as a function of selected characteristics of the roving and the spinning apparatus and a tolerance range for the time period representative of a statistical range of time periods required for bobbin exhaustion. The automatic bobbin exchanging means is then actuated to exchange the roving bobbins associated with a respective group of spinning stations when the number thereof having uncorrectable yarn breaks exceeds a first predetermined value before the elapsed operating time of the associated roving bobbins reaches the tolerance range of the time period and also when such number of down spinning stations exceeds a second predetermined value thereafter. The several groups of spinning stations are cyclically checked to identify the number of each thereof having uncorrectable yarn breaks. The number of spinning stations of each group identified as having uncorrectable yarn breaks is stored for purposes of determining actuation of the automatic bobbin exchanging means, but the stored number is cleared for a group of spinning stations upon each actuation of the bobbin exchanging means for the respectively associated bobbins.

DESCRIPTION OF THE PREFERRED EMBODIMENT

Figure 1:
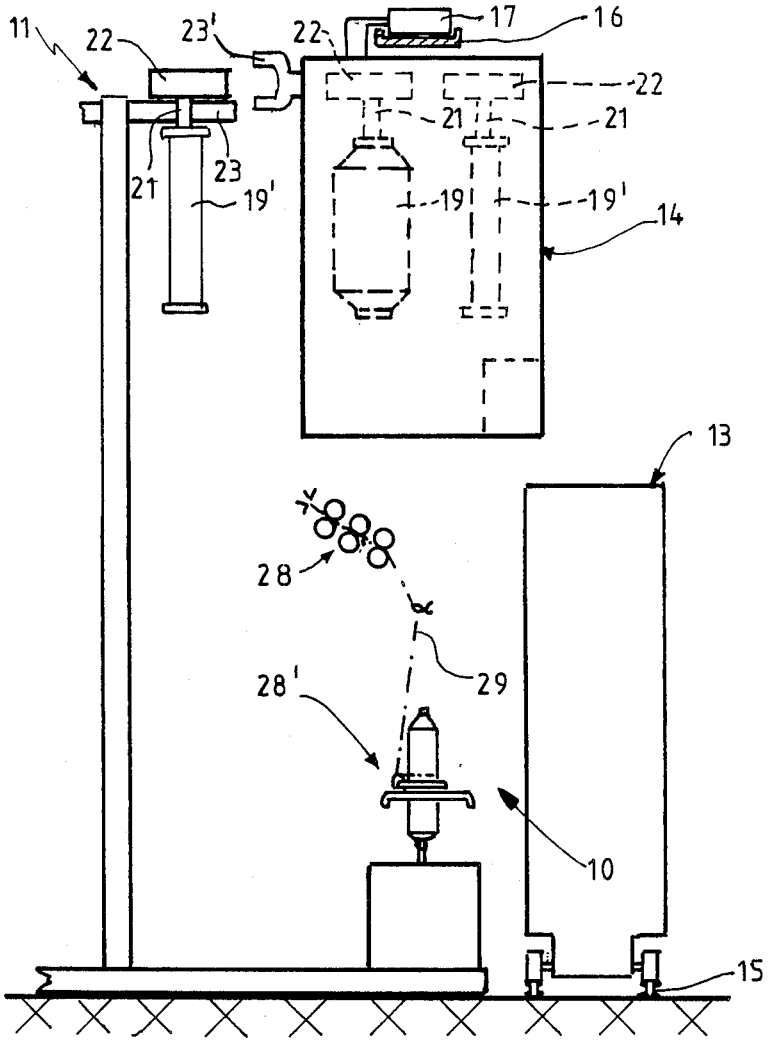
FIG. 1 is a schematic illustration of a single spinning station of a ring spinning machine provided with a traveling yarn piecing carriage and an automatic bobbin exchanger carriage.

Referring now to the accompanying drawings and initially to FIG. 1, a conventional ring spinning machine 11 is schematically shown in end elevation. One spinning station 10 of the ring spinning machine 11 is illustrated for purposes of description of the present invention, although it will of course be understood by those persons skilled in the art that the ring spinning machine 11 includes a plurality of spinning stations 10 arranged in alignment along both opposite longitudinal sides of the machine 11. For example, a ring spinning machine of this type may include from several hundred to over a thousand spinning stations. A yarn piecing carriage assembly 13 and a bobbin exchanging carriage assembly 14 are arranged in association with the ring spinning machine 11. As will be understood, the carriage assemblies 13,14 may be set up in conventional manner for operation exclusively with the ring spinning machine 11 or, as alternatively necessary or desirable, for servicing a number of such spinning machines. The frame of the ring spinning machine 11 is provided with elevated horizontally-extending cross-rails 23 adapted for supporting a series of conventional plate-like carriers 22 from each of which a group of plural roving bobbins 19,19' are pivotably suspended by a plurality of bobbin holders 21. In conventional manner, roving from the roving bobbins 19,19' is delivered at each spinning station to a series of drafting rollers 28 for drawing the roving to the desired yarn count and therefrom the drawn roving is delivered to a conventional ring spinning arrangement 28' at the respective spinning station for twisting into yarn and winding onto a tube supported on an upright spinning spindle.

The yarn piecing carriage assembly 13 is of essentially conventional construction designed for traveling movement on floor-supported rails 15 longitudinally alongside the spinning stations 10 of the ring spinning machine 11, the carriage 13 including a conventional arrangement for detecting, locating and piecing yarn breaks at the spinning stations 10. Similarly, the bobbin exchanging carriage assembly 14 is of an essentially conventional design having rollers 17 from which the carriage assembly 14 is suspended from a rail 16 for traveling movement longitudinally with respect to the spinning machine 11 at an elevation thereabove adjacent the roving bobbin creel. The bobbin exchanging carriage assembly 14 is conventionally adapted for removing a roving bobbin carrier 22 from the cross-rails 23 of the ring spinning machine 11 and replacing the removed carrier 22 with another roving bobbin carrier 22 to enable the simultaneous exchange of a group of full roving bobbins 19 supported on the replacement carrier 22 for a group of spent or partially spent roving bobbins 19' supported on the carrier 22 in use. For this purpose, the bobbin exchanging carriage assembly 14 is provided with sufficient storage capacity for carrying several roving bobbin carriers 22. The carriage assembly 14 includes a gripping device 23' adapted to engage and remove a bobbin carrier 22 from the frame of the ring spinning machine 11 and place the carrier 22 together with its spent or partially spent bobbins 19' within the storage area of the carriage assembly 14 and for transferring a new replacement carrier 22 with full roving bobbins 19 from the storage area onto the machine frame. Preferably, the bobbin exchanging carriage assembly 14 is adapted for automatically performing this exchange procedure upon each actuation of the carriage assembly 14. Of course, as those persons skilled in the art will readily recognize, the bobbin exchanging carriage assembly 14 may be of any other suitable construction and design for performing this basic manner of group bobbin exchange. As aforementioned, roving breakage problems may be experienced if the carriage assembly 14 does not precisely transfer the new bobbin carrier 22 into proper position on the frame rails 23 of the ring spinning machine 11.

During the normal operation of the ring spinning machine 11, the yarn piecing carriage assembly 13 continuously travels back and forth along the length of the machine 11 alongside its spinning stations 10 to detect spinning stations at which yarn breaks have occurred. At each spinning station 10 having a yarn break, the yarn piecing carriage assembly 13 is adapted to stop and attempt to locate the broken yarn ends and piece them together, all in a conventional manner. Assuming the yarn piecing operation is successful within a predetermined number of piecing attempts, the yarn breakage is thereby eliminated and the yarn piecing carriage assembly 13 resumes its traveling operation to proceed for detecting other yarn breakages.

On the other hand, if the yarn piecing carriage assembly 13 is unsuccessful in correcting the yarn breakage at a spinning station 10 within the predetermined number of attempts, the carriage assembly 13 is programmed to consider the spinning station 10 to be "down" or "dead", i.e. having an uncorrectable yarn breakage, and the carriage assembly 13 then proceeds with its traveling operation rather than continue attempts to correct the yarn breakage. During normal operation of a ring spinning machine, it is relatively rare that spinning stations become down with uncorrectable yarn breaks other than when the respective roving bobbins are fully spent, although as aforementioned a significant percentage of spinning stations on occasion may become down with uncorrectable yarn breaks due to defective or poor quality roving or improper positioning of roving bobbin carriers. According to the present invention, the actuation of the roving bobbin exchanging carriage assembly 14 associated with the ring spinning machine 11 is controlled as a function of the number of spinning stations identified as down with uncorrectable yarn breakages and as a further function of the total elapsed time since the preceding bobbin exchange procedure according to a control procedure designed to postpone bobbin exchange during normal machine operation until the roving bobbins are substantially spent but to initiate a premature roving bobbin exchange procedure under circumstances indicating an unusual roving breakage problem.

Figure 2:
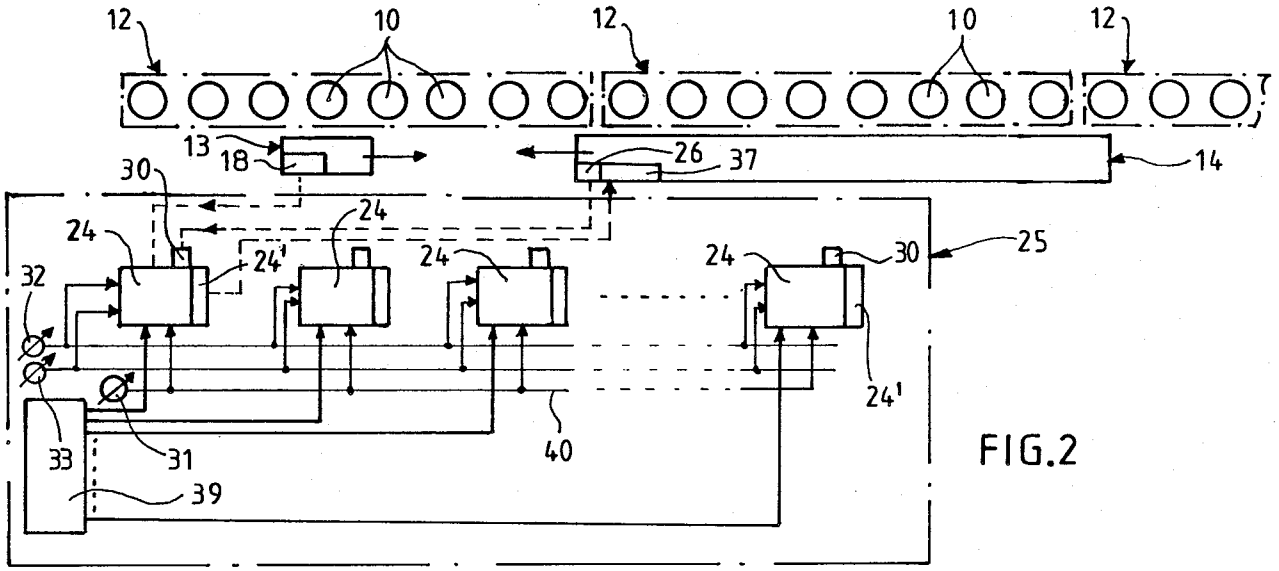
FIG. 2 is a schematic diagram of a microprocessor arranged according to the method and apparatus of the present invention for monitoring the yarn piecing carriage and actuating operation of the bobbin exchanger carriage.

As represented diagrammatically in FIG. 2, the spinning stations 10 of the ring spinning machine 11 are divided into groups or sections, indicated at 12 in broken lines, each of which includes an equal number of adjacent aligned spinning stations 10, indicated in FIG. 2 schematically by circles. In the present invention, essentially no restrictions exist on the number of spinning stations 10 in each individual group or section 12. Preferably, the number of spinning stations in each group is compatible with the number of roving bobbins in each carrier 22 so that the bobbin exchanging carriage assembly 14 can accomplish simultaneous exchange of all roving bobbins associated with a given group of spinning stations. In such case, the number of spinning stations in each group is appropriately relatively small, e.g. from six to twelve spinning stations. If a microprocessor or similar control unit is utilized, the number of spinning stations in a group may appropriately be set at eight to enable simple and effective information processing with an eight-bit microprocessor. On the other hand, the present invention may utilize a bobbin exchanging apparatus adapted for sequential rather than simultaneous exchange of the roving bobbins associated with each individual spinning station group, in which case substantially no restriction exists on the number of spinning stations in each group so that, for example, each group may include from ten to thirty spinning stations or any other appropriate number. In the preferred embodiment illustrated in FIG. 2, each group 12 includes eight spinning stations 10 by way of example for purposes of illustration and description of the present invention.

As seen in FIG. 2, the present invention provides a central microprocessor 25 associated with the ring spinning machine 11, the microprocessor 25 having a plurality of individual storage units 24 each of which is associated with a respective one of the groups 12 of spinning stations 10. The yarn piecing carriage assembly 13 is provided with a signal generator 18 adapted to detect and report down spinning stations 10 to the appropriate microprocessor storage unit 24 associated with the respective spinning station group 12. As appropriate or desirable, a radio or wire conductor system may be utilized for accomplishing such communication from the piecing carriage assembly 13 to the microprocessor 25. Each storage unit 24 is provided with a suitable means of storing the information reported by the yarn piecing carriage assembly 13, which may be a single storage location within each storage unit 24 or a circulating-type storage unit having a storage location for each spinning station 10 of the respective group 12, the down spinning stations being recorded for example in binary fashion. As necessary or desirable, each storage unit 24 may be provided with a counter for counting the number of reported down spinning stations of the respective group 12. Each storage unit 24 is additionally provided with a time meter 30 arranged to measure the cumulative elapsed operating time of the respective group 12 of spinning stations 10 associated with its storage unit 24.

Each storage unit 24 has an actuating command element 24' which is operatively arranged in communication with an actuation control unit 37 on the bobbin exchanging carriage assembly 14, preferably by appropriate radio or wire conductor means therebetween, to enable each storage unit 24 to signal the bobbin exchanging carriage assembly 14 to actuate a roving bobbin exchange operation at the respectively associated spinning station group 12. Upon receiving any such signal from one of the storage units 24, the control unit 37 actuates traveling movement of the bobbin exchanging carriage assembly 14 to the respective spinning station group 12 and then actuates a bobbin exchange operation thereat in the aforedescribed manner. In the event the control unit 37 receives signals from two or more of the storage unit command elements 24' at essentially the same time, the control unit 37 is adapted for storing and recalling such actuating signals and to proceed to carry out the appropriate roving bobbin exchange operations at the several spinning station groups 12 in sequence according to the then current traveling position of the bobbin exchanging carriage assembly 14 by traveling first to the nearest spinning station group 12 requiring bobbin exchange, then to the next closest group 12, and so on.

The bobbin exchanging carriage assembly 14 is similarly provided with a signal device 26 which is operatively connected in suitable manner with each of the storage units 24 of the microprocessor 25, such as by a radio signaling means or wire conducting means, to report to the storage units 24 each occurrence of a bobbin exchanging operation at the respective spinning station groups 12. The microprocessor 25 is appropriately programmed to clear the stored value of down spinning stations from each storage unit 24 upon the occurrence of a bobbin exchanging operation at the respective spinning station group 12 so that the storage status of the storage unit 24 begins at a zero value each time full roving bobbins 19 are placed in service at the respective spinning station group 12. Similarly, the microprocessor 25 is also programmed to reset the elapsed time meter 30 of each storage unit 24 to a zero time value upon each roving bobbin exchange at the respectively associated spinning station group 12.

As aforementioned, each actuation of the bobbin exchanging carriage assembly 14 is controlled at each spinning station group 12 in relation to the total number of spinning stations 10 thereof identified as being down with uncorrectable yarn breaks and in further relation to the total elapsed time of spinning operation since the immediately preceding bobbin exchange. For this purpose, the microprocessor 25 is equipped with a manually adjustable time generator 31 and manually adjustable number generators 32 and 33, each of which is independently arranged for commonly programming each storage unit 24 with a respective time or numerical value. More specifically, the time generator 31 is adapted to enter two time values into each storage unit 24. One such time value represents a predetermined average elapsed time period that is theoretically required to completely exhaust the entire roving supply on a full roving bobbin under the prevailing spinning conditions. This time value, which may be identified as $Dt_{vo}$, is determined by theoretical calculation as a function of the total roving weight G on the full bobbin, the roving count $N_m$, and the prevailing drafting speed $V_E$ of the drafting system of the ring spinning machine 11, according to the equation $Dt_{vo}=N_m \times G/V_E$. As appropriate, this time value $Dt_{vo}$ may be calculated in seconds or minutes. The second time value controlled by the time generator 31 is a value representing a tolerance value, designated $Dt_z$, which allows for the statistical differences in actual measured times required for complete exhaustion of full roving bobbins, thereby indicating the statistical deviation of actual bobbin exhaustion times from the theoretically calculated value $Dt_{vo}$. For each spinning station group 12, the actual elapsed time measured by the time meter 30 from the inception of each roving bobbin exchange at the respective group 12 is designated $t_v$. As will thus be understood, the calculated time value $Dt_{vo}$ assumes that the elapsed time value $t_v$ equals zero.

Figure 3:
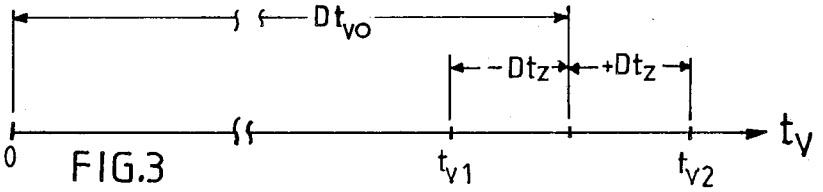
FIG. 3 is a time diagram representing the aforesaid theoretically calculated bobbin exhaustion period and the tolerance range thereof.

The tolerance value $Dt_z$ will best be understood with reference to FIG. 3 which graphically represents the relationship of the time values $Dt_{vo}$ and $Dt_z$ with respect to the cumulative elapsed operating time $t_v$ of a full roving bobbin wherein the zero value of elapsed time $t_v$ represents the start of spinning operation with the full bobbin. As will therefore be seen, a tolerance time range begins at the elapsed time $t_{v1}$, which represents the tolerance time value $Dt_z$ subtracted from the theoretically calculated value $Dt_{vo}$, and ends at the elapsed time value $t_{v2}$, which represents the tolerance time value $Dt_z$ added to the theoretically calculated time value $Dt_{vo}$. Thus, for example, the tolerance time value $Dt_z$ may be selected so that, under normal operating circumstances, the roving of the several bobbins associated with any given spinning station group 12 will exhaust at the earliest at elapsed time value $t_{v1}$ and at the latest at the time value $t_{v2}$.

As mentioned, the theoretical time value $Dt_{vo}$ is assumed to begin at the zero value of elapsed time $t_v$, i.e. at the start-up of each respective spinning station group 12 with a new group of full bobbins. However, as will be understood, the time value $Dt_{vo}$ is ordinarily a relatively large value so that it is unnecessary that the time meters 30 of the respective storage units 24 be arranged to start precisely at the moment of start-up of the respective spinning station groups 12. Instead, for example, the time meters 30 may be arranged to measure the elapsed time value $t_v$ from the time the bobbin exchanging carriage assembly 14 resumes its traveling operation after completing the roving bobbin exchange operation preceding the station group start-up or at some other point in time that is reasonably close to the start-up of the spinning operation with the full replacement bobbins.

The number generators 32 and 33 are arranged to enable manual setting of respective whole number values, designated "m" and "n", representing for each spinning station group 12 a first number m of the spinning stations 10 at which it is predetermined to initiate a roving bobbin exchange when such number m of the spinning stations 10 of a group 12 is identified as being down with uncorrectable yarn breaks during the portion of each elapsed time period $t_v$ in advance of the beginning of the time tolerance range at $t_{v1}$ and, similarly, a second number n of the spinning stations 10 of each group 12 at which it is predetermined to initiate a roving bobbin exchange when such number n of the spinning stations 10 of a group 12 are identified as being down with uncorrectable yarn breaks after the elapsed operating time $t_v$ enters the preset time tolerance range. The m and n values may be selected to be equal or different from one another as determined to be necessary or desirable for any particular operating circumstances. By way of example, in the operation of a ring spinning machine wherein spinning stations are divided into groups of eight as illustrated in FIG. 2, it is considered appropriate in many cases for the value m to be at least four and the value n to be at least one.

The microprocessor 25 is further provided with a cyclically operating inquiry device 39 which is arranged to sequentially query the storage units 24 in cycles occurring at predetermined intervals to determine the respectively stored values of the spinning stations 10 of each group 12 which have been identified as being down with uncorrectable yarn breaks. By way of example, the interval between two successive query cycles may be set to approximate the average time of a complete detection run of the yarn piecing carriage assembly 13 along the spinning stations 10 of the ring spinning machine 11. As necessary or desirable, the interval of the cyclical inquiry conducted by the device 39 may be programmed to be relatively longer or shorter or even to proceed continuously in unusual circumstances. This cyclical querying by the device 39 may be relatively rapid as in conventional EDP systems.

In operation, the time and number generators 31,32,33 are pre-set by a machine operator or other suitable personnel in accordance with the predetermined spinning program and thereby supply the pre-set time values $Dt_{vo}$ and $Dt_z$ and the pre-set numerical values m and n to each of the storage units 24 wherein such values are stored. Throughout the operation of the ring spinning machine 11, upon each bobbin exchange operation of the bobbin exchanging carriage assembly 14, the signal device 26 thereof actuates an automatic clearing of the storage unit 24 respectively associated with the group 12 of spinning stations 10 whereat the bobbin exchange occurred to reset to zero the stored value therein representing the number of group's spinning stations 10 identified as down with uncorrectable yarn breaks and further to reset the time meter 30 associated with the storage unit 24 to a zero elapsed time value. Thereafter, as operation of the ring spinning machine 11 continues, the time meter 30 associated with the storage unit 24 cumulatively measures the total elapsed operating time $t_v$ for such spinning station group 12. As machine operation progresses, the inquiry device 39 interrogates the storage unit 24 in cycle with the other storage units 24. The yarn piecing carriage assembly 13 continues its normal traveling movement for correcting any yarn breaks which may occur and, in the event of any uncorrectable yarn breaks, its signal generator 18 reports any spinning stations 10 identified as down with uncorrectable yarn breaks to the storage unit 24 associated with the respective group of spinning stations.

For as long as the total elapsed operating time value $t_v$ for a spinning station group 12 is less than the elapsed time value $t_{v1}$ as determined by the setting of the time generator 31, the inquiry device 39 interrogates the associated storage unit 24 to determine whether the number of its associated spinning stations 10 recorded as down with uncorrectable yarn breaks is equal to or greater than the predetermined number m set by the number generator 32. If such is the case, the inquiry device 39 reports such circumstance to the actuation command element 24' of the storage unit 24 which in turn electronically instructs the control unit 37 of the bobbin exchanging carriage assembly 14 to travel to the associated group 12 of spinning stations 10 to accomplish a roving bobbin exchange operation thereat. On the other hand, if the number of down spinning stations recorded in the storage unit 12 is less than the number m, no roving bobbin exchange is actuated. When the total elapsed operating time $t_v$ of a spinning station group 12 has exceeded the time value $t_{v1}$, the inquiry device 39 interrogates the associated storage unit 24 to determine whether the number of spinning stations 10 recorded as down with uncorrectable yarn breaks is equal to or greater than the predetermined number n preset by the number generator 33. In such case, the inquiry device 39 reports such circumstance to the command element 24' of the associated storage unit 24 which in turn instructs the control unit 37 of the bobbin exchanging carriage assembly 14 to travel to and accomplish a bobbin exchange operation at the associated spinning station group. On the other hand, if the number of down spinning stations is less than the preset number n, no roving bobbin exchange operation is actuated. As will be understood, if the preset number n is smaller than the preset number m and the number of down spinning stations has exceeded the number n but not the number m during the initial elapsed time $t_{v1}$, the inquiry device 39 will actuate a roving bobbin exchange operation at the associated spinning station group 12 during the first inquiry cycle occurring after the respective spinning station group enters the tolerance time range at elapsed time value $t_{v1}$.

In the event the total number of spinning stations 10 reported as down with uncorrectable yarn breaks for any given group 12 of spinning stations 10 does not exceed either of the values m or n during the pertinent elapsed time periods, the microprocessor 25 is arranged to actuate the bobbin exchanging carriage assembly 14 to accomplish a bobbin exchange operation at the respective spinning station group as soon as the total elapsed operating time reaches the time value $t_{v2}$ or during the first inquiry cycle of the inquiry device 39 following the time value $t_{v2}$. In this manner, a bobbin exchange operation is carried out at each group 12 of spinning stations 10 in no event later than the elapse of the preset time period $t_{v2}$. For example, the time meter 30 of each storage unit 24 may be programmed to actuate its associated storage unit 24 to increase the stored number of spinning stations recorded as down with uncorrectable yarn breaks to the total number of the spinning stations 10 in the group 12 immediately upon reaching the preset time value $t_{v2}$ so that a roving bobbin exchange at the associated spinning station group 12 will inevitably be actuated during the next query cycle of the inquiry device 39. Alternatively, the time meter 30 may initiate a roving bobbin exchange immediately at the elapsed time $t_{v2}$.

While as aforementioned the microprocessor 25 in association with the signal generator 26 of the bobbin exchanging carriage assembly 14 is arranged to clear the stored value in a storage unit 24 representing the number of identified down spinning stations 10 of the associated spinning station group 12 upon each bobbin exchange operation thereat, it is contemplated that provision may be made so that spinning stations 10 which are down for reasons other than the absence of roving, e.g., spinning stations 10 requiring repair, continue to be identified as down even after a roving bobbin exchange operation until the cause of the non-operation of any such spinning station 10 is corrected. In this manner, the yarn piecing operation of the yarn piecing carriage assembly 13 will not be delayed by a stoppage at such spinning stations 10 for unnecessary attempts at yarn breakage correction. It is also contemplated that provision may be made so that any spinning stations 10 recorded in the associated storage units 24 as being down may be cleared from the respective storage unit 24 in advance of a roving bobbin exchange at the associated spinning station group 12 in the event such spinning stations 10 are returned to normal yarn production service without the necessity of a roving bobbin exchange. For example, a spinning station 10 may be identified as being down with an uncorrectable yarn break resulting from a broken traveler or as a result of debris or roving being wrapped around a drafting roller, either of which may be readily corrected by a machine operator to eliminate the stoppage at the spinning station 10 whereupon no necessity exists for continuing to consider such spinning station 10 as down. It would therefore be advantageous to clear any recording of such a spinning station 10 as down from the associated storage unit 24, which may be accomplished for example manually by a machine operator or automatically as a result of the elimination of the yarn break at the spinning station.

It is also contemplated that spinning stations having uncorrectable yarn breaks may be identified and recorded as being down by means other than the above-described embodiment. For example, the machine operator or operators may manually record the spinning stations as being down. Spinning stations may be provided with swingable yarn guides which may be moved to an inoperative position to identify a down spinning station. Further, the bobbin exchanging carriage assembly 14 may itself be arranged to travel along the length of the ring spinning machine 11 either continuously or periodically for detecting spinning station groups 12 having a greater than predetermined number of down spinning stations so as to require a bobbin exchange operation. For this purpose, the bobbin exchanging carriage assembly 14 may be provided with equipment that detects and counts nonoperating yarn guides to identify the number of down spinning stations at each group and to stop at such spinning station groups 12 to carry out a necessary roving bobbin exchange operation before continuing the detection travel of the carriage assembly 14.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for automatically exchanging roving bobbins in a textile yarn spinning apparatus of the type having a plurality of yarn spinning stations fed by a plurality of roving bobbins, an automatic bobbin exchanging means for exchanging full roving bobbins for roving bobbins in feeding use, and a traveling yarn piecing carriage for correcting yarn breaks at said spinning stations, said method comprising the steps of dividing said spinning stations into groups each of a plurality of adjacent spinning stations, monitoring said spinning stations of each group having a yarn break which said yarn piecing carriage cannot successfully correct, and actuating said automatic bobbin exchanging means to exchange the roving bobbins associated with a respective group of spinning stations in relation to the number thereof having uncorrectable yarn breaks.

2. The method of claim 1 and characterized further by monitoring the elapsed time following each bobbin exchange and actuating said automatic bobbin exchanging means to exchange the roving bobbins associated with a respective group of spinning stations in relation to the elapsed operating time of the associated roving bobbins.

3. The method of claim 2 and characterized further by establishing a theoretically calculated time period required for complete exhaustion of a full roving bobbin as a function of selected characteristics of said roving and said spinning apparatus and a tolerance range for said time period representative of a statistical range of time periods required for bobbin exhaustion, and actuating said automatic bobbin exchanging means to exchange the roving bobbins associated with a respective group of spinning stations when the number thereof having uncorrectable yarn breaks exceeds a first predetermined value before the elapsed operating time of the associated roving bobbins reaches said tolerance range of said time period and a second predetermined value thereafter.

4. The method of claim 1 or 3 and characterized further by cyclically checking said groups of spinning stations to identify the number of each thereof having uncorrectable yarn breaks.

5. The method of claim 1 and characterized further by storing the number of spinning stations of each group thereof identified as having uncorrectable yarn breaks and clearing the stored number for a group of spinning stations upon each actuating of said bobbin exchanging means for the respectively associated bobbins.

6. In a textile yarn spinning apparatus of the type having a plurality of yarn spinning stations fed by a plurality of roving bobbins, an automatic bobbin exchanging means for exchanging full roving bobbins for roving bobbins in feeding use, and a traveling yarn piecing carriage for automatically exchanging roving bobbins comprising means for monitoring said spinning stations in groups thereof each of a plurality of adjacent spinning stations to identify the number of spinning stations of each group having a yarn break which said yarn piecing carriage cannot successfully correct, and means for actuating said automatic bobbin exchanging means to exchange the roving bobbins associated with a respective group of spinning stations in relation to the number thereof having uncorrectable yarn breaks.

7. The apparatus of claim 6 and characterized further by timer means for monitoring the elapsed time following each actuation of said automatic bobbin exchanging means and means for actuating said automatic bobbin exchanging means to exchange the roving bobbins associated with a respective group of spinning stations in relation to the elapsed operating time of the associated roving bobbins.

8. The apparatus of claim 7 and characterized further by program means for storing a theoretically calculated time period required for complete exhaustion of a full roving bobbin as a function of selected characteristics of said roving and said spinning apparatus and a tolerance range for said time period representative of a statistical range of time periods required for bobbin exhaustion and for actuating said automatic bobbin exchanging means to exchange the roving bobbins associated with a respective group of spinning stations when the number thereof having uncorrectable yarn breaks exceeds a first predetermined value before the elapsed operating time of the associated roving bobbins reaches said tolerance range of said time period and a second predetermined value thereafter.

9. The apparatus of claim 6 or 8 and characterized further by means for cyclically checking said groups of spinning stations to identify the number of each thereof having uncorrectable yarn breaks.

10. The apparatus of claim 6 and characterized further by means for storing the number of spinning stations of each group thereof identified as having uncorrectable yarn breaks and for clearing the stored number for a group of spinning stations upon each actuation of said bobbin exchanging means for the respectively associated bobbins.

* * * * *